US010383390B2

(12) United States Patent
Hsu et al.

(10) Patent No.: US 10,383,390 B2
(45) Date of Patent: Aug. 20, 2019

(54) SOLE CUSHIONING MODULE

(71) Applicant: National Taiwan University of Science and Technology, Taipei (TW)

(72) Inventors: Mau-Pin Hsu, Taipei (TW); Wei-Cheng Huang, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 192 days.

(21) Appl. No.: 15/215,563

(22) Filed: Jul. 20, 2016

(65) Prior Publication Data

US 2017/0055633 A1 Mar. 2, 2017

(30) Foreign Application Priority Data

Aug. 27, 2015 (TW) ..... 104128163 A

(51) Int. Cl.
*A43B 3/10* (2006.01)
*A43B 13/28* (2006.01)
(Continued)

(52) U.S. Cl.
CPC ..... *A43B 13/183* (2013.01); *A43B 13/141* (2013.01); *A43B 13/184* (2013.01)

(58) Field of Classification Search
CPC ... A43B 13/141; A43B 13/181; A43B 13/183; A43B 13/184; A43B 13/186; A43B 13/188; A43B 7/32; A63B 25/10
(Continued)

(56) References Cited

U.S. PATENT DOCUMENTS 1,469,920 A * 10/1923 Dutchak ..... A43B 21/30 36/38
1,638,350 A * 8/1927 Long ..... A63B 25/10 36/7.8
(Continued)

FOREIGN PATENT DOCUMENTS

CN 1201685 C 5/2005
CN 200994466 Y 12/2007
(Continued)

OTHER PUBLICATIONS

English machine translation of "FR 2663208 A1" via espacenet.com. Translation performed on Aug. 31, 2018.*

*Primary Examiner* — Jameson D Collier
(74) *Attorney, Agent, or Firm* — CKC & Partners Co., LLC

(57) ABSTRACT

A sole cushioning module includes a contacting plate, a base plate, a connecting portion and a first spring leaf. The contacting plate abuts against a sole. The base plate and the contacting plate form a space. The connecting portion connects with the contacting plate and the base plate. The first spring leaf is located within the space. The first spring leaf connects with the base plate. The first spring leaf is curved and forms a first outer curved surface. A first region of the first outer curved surface abuts against the contacting plate. When the contacting plate moves towards the base plate, the contacting plate presses on the first outer curved surface. The first spring leaf deforms, and the first outer curved surface slides relative to the contacting plate. The first region shifts towards an end of the first spring leaf connecting with the base plate.

10 Claims, 12 Drawing Sheets

(51) Int. Cl.
*A43B 21/30* (2006.01)
*A43B 13/18* (2006.01)
*A43B 13/14* (2006.01)

(58) Field of Classification Search
USPC ..... 36/7.8, 27, 38; 482/77
See application file for complete search history.

(56) References Cited

U.S. PATENT DOCUMENTS 1,736,609 A * 11/1929 Letourneau ..... A43B 3/16 36/7.6
2,172,000 A * 9/1939 Wenker ..... A63B 25/10 267/160
2,953,861 A * 9/1960 Horten ..... A63B 25/10 36/7.8
3,214,849 A * 11/1965 Nadaud ..... A43B 21/32 36/37
3,377,722 A * 4/1968 Downing ..... A43B 13/182 36/7.8
4,492,374 A * 1/1985 Lekhtman ..... A63B 25/10 267/28
4,534,124 A * 8/1985 Schnell ..... A43B 13/18 36/114
4,638,575 A * 1/1987 Illustrato ..... A43B 21/30 36/28
4,894,934 A * 1/1990 Illustrato ..... A43B 21/26 36/102
5,381,608 A * 1/1995 Claveria ..... A43B 13/183 36/27
5,643,148 A 7/1997 Naville
5,678,327 A * 10/1997 Halberstadt ..... A43B 13/18 36/27
5,701,685 A * 12/1997 Pezza ..... A43B 13/18 36/27
6,282,814 B1 * 9/2001 Krafsur ..... A43B 7/1425 36/27
6,684,531 B2 * 2/2004 Rennex ..... A43B 13/182 36/102
6,928,756 B1 * 8/2005 Haynes ..... A43B 13/183 36/27
7,900,377 B1 * 3/2011 Perenich ..... A43B 13/181 36/102
7,905,033 B1 * 3/2011 Perenich ..... A43B 13/181 36/102
7,950,166 B1 * 5/2011 Perenich ..... A43B 13/141 36/102
8,607,478 B2 12/2013 Sokolowski
2005/0126039 A1 * 6/2005 LeVert ..... A43B 7/1425 36/27
2005/0262725 A1 * 12/2005 Rennex ..... A43B 13/14 36/7.8
2011/0138652 A1 6/2011 Lucas et al.

FOREIGN PATENT DOCUMENTS

FR 2663208 A1 * 12/1991 ..... A43B 3/0005
TW M322746 U 12/2007
WO WO 2009064286 A1 * 5/2009 ..... A43B 13/183

* cited by examiner

SOLE CUSHIONING MODULE

RELATED APPLICATIONS

This application claims priority to Taiwanese Application Serial Number 104128163, filed Aug. 27, 2015, which is herein incorporated by reference.

BACKGROUND

Technical Field

The present disclosure relates to a sole cushioning module.

Description of Related Art

When people are getting old, the strains of the feet are accumulatively and naturally increased, which can easily cause different kinds of pain relevant to the feet. Meanwhile, degenerative arthritis is one of the common diseases of the aged people in the society nowadays.

The degenerative arthritis is a progressive disease of non-systemic inflammation happened at movable joints. The cause of the disease is the damage of the articular cartilage mainly due to excessive wear, such that the joint loses the protection by the cartilage. In general, the degenerative arthritis can easily cause further degeneration of the muscular strength of the lower limb. Apart from the inconvenience caused to the movement of the patient, a surgery may be required if the symptom becomes serious. This is undoubtedly a torment to sport-lovers.

In order to alleviate and relieve the patient's symptom, or even help the patient to pleasantly enjoy the health and vitality from sports, how to help the patient to alleviate the burden to the joint of the lower limb when walking, such as effectively minimizing the impact produced to the feet from the ground, or storing the energy when walking such that more effort can be saved, is an important direction of development in the industry nowadays.

SUMMARY

A technical aspect of the present disclosure is to provide a sole cushioning module, which can provide a cushion to a user when stepping, and helps to save more effort when the user moves forwards or jumps upwards through applying a force by the foot.

According to an embodiment of the present disclosure, a sole cushioning module includes a contacting plate, a base plate, a connecting portion and a first spring leaf. The contacting plate abuts against a sole. The base plate is configured to abut against a ground. The base plate and the contacting plate form a space in between. The connecting portion unstretchably connects with the contacting plate and the base plate. The first spring leaf is located within the space. An end of the first spring leaf connects with the base plate. The first spring leaf and the base plate form a first included angle, and the first spring leaf is in a curved shape, such that the first spring leaf forms a first outer curved surface. A first region of the first outer curved surface at least partially abuts against the contacting plate. When the contacting plate moves towards the base plate, the contacting plate presses on the first outer curved surface, such that the first spring leaf deforms and bends, and the first outer curved surface at least partially slides relative to the contacting plate. Consequently, the first region of the first outer curved surface abutting against the contacting plate shifts towards the end of the first spring leaf connecting with the base plate.

In one or more embodiments of the present disclosure, another end of the first spring leaf opposite to the end of the first spring leaf connecting with the base plate is a free end.

In one or more embodiments of the present disclosure, the sole cushioning module further includes a protruding block. The protruding block is located within the space and is connected with the contacting plate. The protruding block has an arcuate surface. A location of the arcuate surface corresponds to the end of the first spring leaf opposite to the end of the first spring leaf connecting with the base plate.

In one or more embodiments of the present disclosure, the sole cushioning module further includes a roller. The roller is located at the end of the first spring leaf opposite to the end of the first spring leaf connecting with the base plate. The roller rolls along the arcuate surface.

In one or more embodiments of the present disclosure, the end of the first spring leaf connecting with the base plate has a first width. Another end of the first spring leaf has a second width. The first width is wider than the second width.

In one or more embodiments of the present disclosure, the end of the first spring leaf connecting with the base plate has a first thickness. Another end of the first spring leaf has a second thickness. The first thickness is thicker than the second thickness.

In one or more embodiments of the present disclosure, the sole cushioning module further includes at least one side stopper. The side stopper is located within the space and is connected with the contacting plate. The side stopper abuts against a side of the first spring leaf.

In one or more embodiments of the present disclosure, the sole cushioning module further includes a second spring leaf. The second spring leaf is located within the space. An end of the second spring leaf connects with the base plate. The second spring leaf and the base plate form a second included angle, and the second spring leaf is in a curved shape, such that the second spring leaf forms a second outer curved surface. A second region of the second outer curved surface at least partially abuts against the contacting plate. The second included angle and the first included angle face to each other.

In one or more embodiments of the present disclosure, a quantity of the second spring leaf is a pair. The first spring leaf is located between the second spring leaves.

In one or more embodiments of the present disclosure, the contacting plate includes a front subsidiary contacting plate, a rear subsidiary contacting plate and a pivoting portion. The front subsidiary contacting plate abuts against a front portion of the sole. The rear subsidiary contacting plate abuts against a rear portion of the sole. The pivoting portion pivotally connects the front subsidiary contacting plate and the rear subsidiary contacting plate, such that the front subsidiary contacting plate and the rear subsidiary contacting plate are able to rotate relatively.

According to another embodiment of the present disclosure, a sole cushioning module includes a contacting plate, a first spring leaf and a second spring leaf. The contacting plate abuts against a sole. The contacting plate has a first connecting point and a second connecting point opposite to each other. The first connecting point and the second connecting point are opposite to the sole. The first spring leaf and the second spring leaf respectively are in a "C" shape and are configured to abut against a ground. The first spring leaf and the second spring leaf respectively form a first opening and a second opening. An end of the first spring leaf connects with the first connecting point. Another end of the first spring leaf is a free end. A part of the first spring leaf near a center of the "C" shape has a first thickness thicker than the ends of the first spring leaf. An end of the second spring leaf connects with the second connecting point. Another end of the second spring leaf is a free end. A part of the second spring leaf near a center of the "C" shape has a second thickness thicker than the ends of the second spring leaf. The first spring leaf and the second spring leaf are disposed opposite to each other, such that the first opening and the second opening face to different directions. When the contacting plate moves towards the ground and presses against the first spring leaf, the first spring leaf at least partially abuts against the contacting plate and forms a first region. An extent of the first region correspondingly increases with the movement of the contacting plate towards the ground. The first spring leaf at least partially abuts against the ground and forms a second region. An extent of the second region correspondingly increases with the movement of the contacting plate towards the ground. When the contacting plate moves towards the ground and presses against the second spring leaf, the second spring leaf at least partially abuts against the contacting plate and forms a third region. An extent of the third region correspondingly increases with the movement of the contacting plate towards the ground. The second spring leaf at least partially abuts against the ground and forms a fourth region. An extent of the fourth region correspondingly increases with the movement of the contacting plate towards the ground.

In one or more embodiments of the present disclosure, the first spring leaf has a first abutting point. The first abutting point is located at an end of the second region near to the first opening. The second spring leaf has a second abutting point. The second abutting point is located at an end of the fourth region near to the second opening. A first distance between the first abutting point and the second abutting point is longer than a second distance between the first connecting point and the second connecting point.

In one or more embodiments of the present disclosure, the contacting plate includes a front subsidiary contacting plate, a rear subsidiary contacting plate and a pivoting portion. The front subsidiary contacting plate abuts against a front portion of the sole. The rear subsidiary contacting plate abuts against a rear portion of the sole. The pivoting portion pivotally connects the front subsidiary contacting plate and the rear subsidiary contacting plate, such that the front subsidiary contacting plate and the rear subsidiary contacting plate are able to rotate relatively.

When compared with the prior art, the above-mentioned embodiments of the present disclosure have at least the following advantages:

(1) With the pressing of contacting plate against the first spring leaf, the difficulty for the first spring leaf to keep deforming and bending will be increased, such that the equivalent stiffness of the first spring leaf will change with an amplitude of non-linear increment with regard to the increase of the compression distance between the contacting plate and the base plate. In this way, when the user steps on the ground, the sole cushioning module will effectively absorb the force the user steps on the ground through the deformation and bending of the first spring leaf. Thus, the user is cushioned when stepping, and the chance of injury of the leg, especially the joint of lower limb, caused by too large the reaction force when the user steps is reduced. In addition, as mentioned above, the equivalent stiffness of the first spring leaf will gradually change with an amplitude of non-linear increment, until the first spring leaf deforms and bends to an extent capable to support the force that the user steps on the ground. Therefore, the process from cushioning to supporting by the first spring leaf to the stepping force of the user can be carried out smoothly. When the user use his foot to pedal downwards, the first spring leaf will spring back to release the elastic potential energy stored, and provide an elastic force to the contacting plate. This facilitates to lift up the contacting plate and the sole, such that the user can save more effort when moving forwards or jumping upwards through the additional elastic force from the sole cushioning module.

(2) Through the pre-compression of the first spring leaf, the initial distance between the contacting plate and the base plate becomes closer, such that the overall height of the sole cushioning module can be reduced, facilitating the stability of the sole cushioning module when used by the user.

(3) Through the pivoting portion which allows the front subsidiary contacting plate and the rear subsidiary contacting plate to rotate relatively, the sole cushioning module can effectively match with the normal and natural gait of the user.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
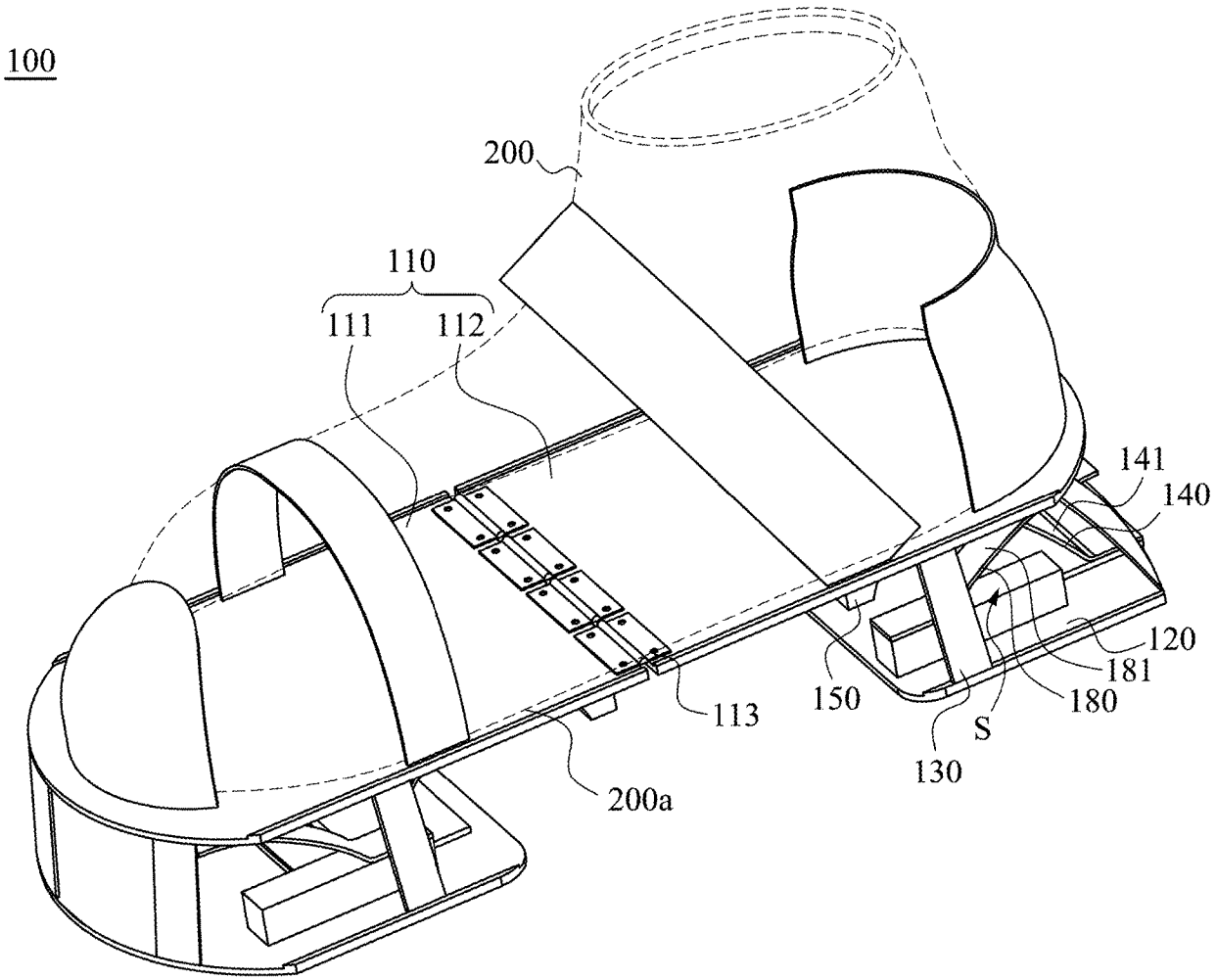
FIG. 1 is a schematic view of a sole cushioning module according to an embodiment of the present disclosure.

Drawings will be used below to disclose embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meanings as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 2:
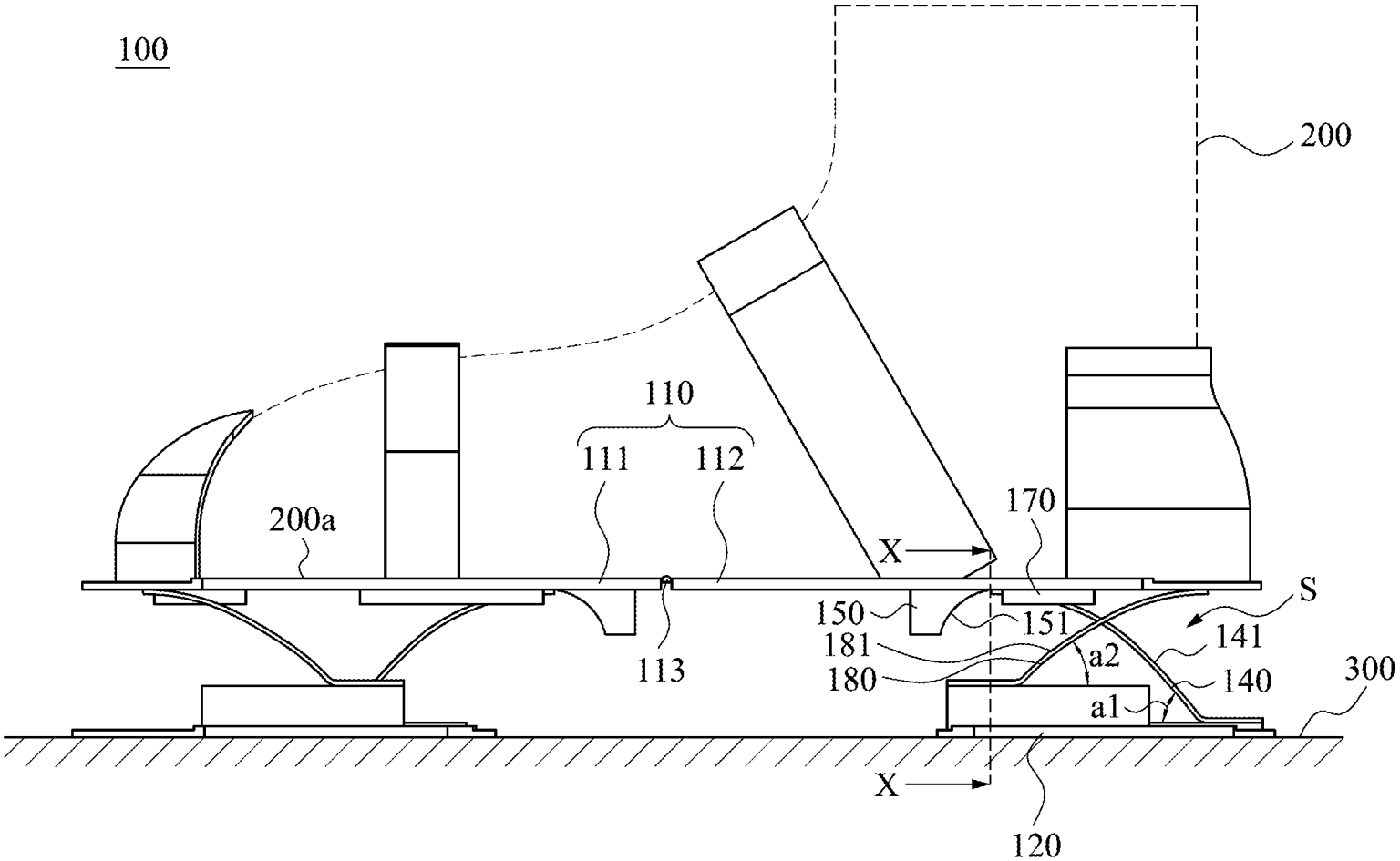
FIG. 2 is a side view of the sole cushioning module of FIG. 1, with the connecting portion not shown.

Reference is made to FIGS. 1-2. FIG. 1 is a schematic view of a sole cushioning module 100 according to an embodiment of the present disclosure. FIG. 2 is a side view of the sole cushioning module 100 of FIG. 1, with the connecting portion 130 not shown. As shown in FIGS. 1-2, a sole cushioning module 100 includes a contacting plate 110, a base plate 120, a connecting portion 130 (please refer to FIG. 1) and a first spring leaf 140. The contacting plate 110 abuts against a sole 200*a*. In practical applications, the contacting plate 110 and the sole 200*a* can be an integrally formed structure. The base plate 120 is configured to abut against a ground 300. The base plate 120 and the contacting plate 110 form a space S in between. The connecting portion 130 unstretchably connects with the contacting plate 110 and the base plate 120. The first spring leaf 140 is located within the space S. An end of the first spring leaf 140 connects with the base plate 120. The first spring leaf 140 and the base plate 120 form a first included angle a1, and the first spring leaf 140 is in a curved shape, such that the first spring leaf 140 forms a first outer curved surface 141. A first region 141*a* of the first outer curved surface 141 at least partially abuts against the contacting plate 110. When the contacting plate 110 moves towards the base plate 120, the contacting plate 110 presses against the first outer curved surface 141, such that the first spring leaf 140 deforms and bends, and the first outer curved surface 141 at least partially slides relative to the contacting plate 110. Consequently, the first region 141*a* of the first outer curved surface 141 abutting against the contacting plate 110 shifts towards the end of the first spring leaf 140 connecting with the base plate 120.

In other words, when a user wears a shoe 200, and the contacting plate 110 of the sole cushioning module 100 abuts against the sole 200*a* of the shoe 200, the force that the user steps on the ground 300 will be transmitted to the first spring leaf 140 through the contacting plate 110. At the same time, the force that the user steps on the ground 300 will come together with a reaction force from the ground 300 against the base plate 120. The reaction force is of the same magnitude but opposite direction to the force that the user steps on the ground 300. Because of the reaction force acting against the base plate 120 and thus the first spring leaf 140, it can also be understood that the reaction force is transmitted to the first spring leaf 140 through the base plate 120. To be more specific, when the user steps on the ground 300, the sole 200*a* together with the contacting plate 110 move towards the ground 300, as shown in FIG. 2. Since the base plate 120 abuts against the ground 300, in other words, the contacting plate 110 moves towards the base plate 120 with the support of the reaction force from the ground 300 against the base plate 120.

Figure 3:
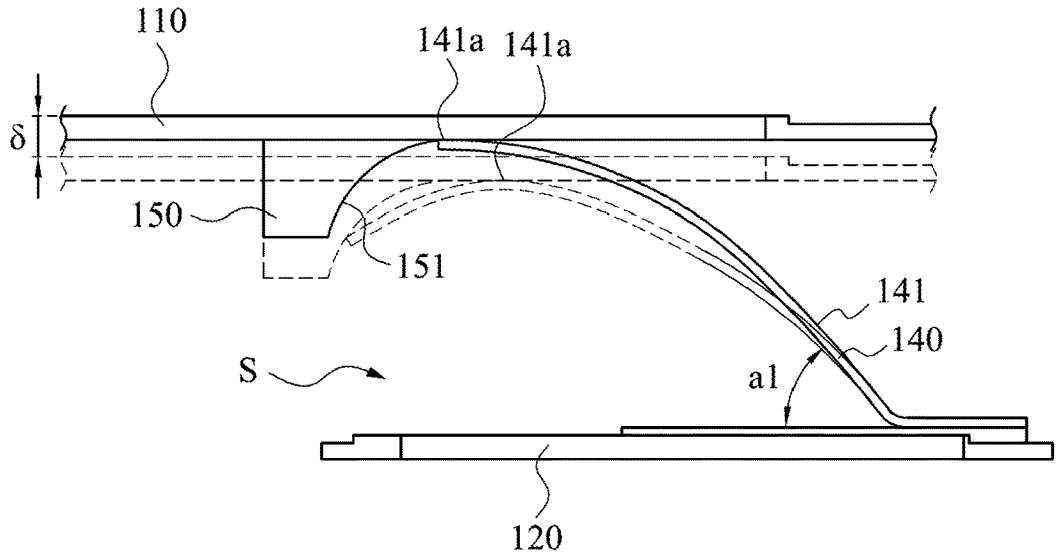
FIG. 3 is a schematic view of the deformation and bending of the first spring leaf of FIG. 1.

Please refer to FIG. 3. FIG. 3 is a schematic view of the deformation and bending of the first spring leaf 140 of FIG. 1. As shown in FIG. 3, another end of the first spring leaf 140 opposite to the end of the first spring leaf 140 connecting with the base plate 120 is a free end. When the contacting plate 110 moves towards the base plate 120, the contacting plate 110 presses against the first outer curved surface 141 of the first spring leaf 140, such that the first spring leaf 140 deforms and bends. With the deformation and bending of the first spring leaf 140, the first spring leaf 140 stores an elastic potential energy. In addition, when the first spring leaf 140 deforms and bends, the first outer curved surface 141 of the first spring leaf 140 at least partially slides relative to the contacting plate 110. Consequently, the first region 141*a* of the first outer curved surface 141 abutting against the contacting plate 110 gradually shifts towards the end of the first spring leaf 140 connecting with the base plate 120.

When the first region 141*a* of the first outer curved surface 141 abutting against the contacting plate 110 gradually shifts towards the end of the first spring leaf 140 connecting with the base plate 120, it represents that the bending moment which the contacting plate 110 exerts on the first spring leaf 140 is correspondingly reduced gradually. On the other hand, since the first spring leaf 140 is a cantilever of a curved shape, when the first region 141*a* gets close to the end of the first spring leaf 140 connecting with the base plate 120, the degree of deformation of the first spring leaf 140 is correspondingly reduced. This means that when the first spring leaf 140 resists to the pressing of the contacting plate 110 against the first spring leaf 140, the effect of corresponding increase of the stiffness of the first spring leaf 140 is achieved.

Figure 4:
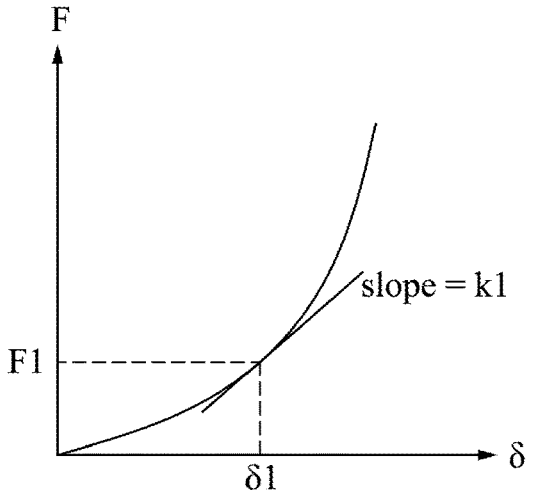
FIG. 4 is a graph showing an equivalent stiffness of the first spring leaf of FIG. 1.

Reference is made to FIG. 4. FIG. 4 is a graph showing an equivalent stiffness k of the first spring leaf 140 of FIG. 1. As shown in FIG. 4, the slope of the curve of FIG. 4 is equal to the equivalent stiffness k of the first spring leaf 140, in which the equivalent stiffness k is the stiffness of the first spring leaf 140 against the vertical force F from the contacting plate 110. Under the condition of reducing bending moment and increasing stiffness, with the pressing of contacting plate 110 against the first spring leaf 140, the difficulty for the first spring leaf 140 to keep deforming and bending will be increased, such that the equivalent stiffness k (i.e., the ability to resist against pressure) of the first spring leaf 140 will change with an amplitude of non-linear increment with regard to the increase of the compression distance δ (please refer to FIG. 3, the compression distance δ corresponds to the degree of the deformation and bending of the first spring leaf 140) between the contacting plate 110 and the base plate 120. In this way, when the user steps on the ground 300, the sole cushioning module 100 will effectively absorb the force the user steps on the ground 300 through the deformation and bending of the first spring leaf 140. Thus, the user is cushioned when stepping, and the chance of injury of the leg, especially the joint of lower limb, caused by too large the reaction force when the user steps is reduced. In addition, as mentioned above, the equivalent stiffness k of the first spring leaf 140 will gradually change with an amplitude of non-linear increment, until the first spring leaf 140 deforms and bends to an extent capable to support the force that the user steps on the ground 300. Therefore, the process from cushioning to supporting by the first spring leaf 140 to the stepping force of the user can be carried out smoothly. When the user use his forefoot to pedal downwards, the first spring leaf 140 will spring back to release the elastic potential energy stored, and provide an elastic force to the contacting plate 110. This facilitates to lift up the contacting plate 110 and the sole 200*a*, such that the user can save more effort when moving forwards or jumping upwards through the additional elastic force from the sole cushioning module 100.

As mentioned above, the connecting portion 130 unstretchably connects with the contacting plate 110 and the base plate 120. To be further illustrated, in order to make the equivalent stiffness k of the first spring leaf 140 start functioning from a specific level, the connecting portion 130 can connect with the contacting plate 110 and the base plate 120 under the pre-compressed condition of the first spring leaf 140. For example, as shown in FIG. 4, a compression distance δ1 is pre-compressed between the contacting plate 110 and the base plate 120 under a vertical force F1. Thus, before the user steps on the ground 300, the equivalent stiffness k of the first spring leaf 140 already reaches an equivalent stiffness k1. In other words, the equivalent stiffness k of the first spring leaf 140 produced by the pressing of the user afterwards develops from the equivalent stiffness k1. As a result, the effect of cushioning and supporting the pressure from the user by the first spring leaf 140 become more obvious right from the initial status. In addition, through the pre-compression of the first spring leaf 140, the initial distance between the contacting plate 110 and the base plate 120 becomes closer, such that the overall height of the sole cushioning module 100 can be reduced, facilitating the stability of the sole cushioning module 100 when used by the user. For example, before the user steps on the ground 300, the initial distance between the contacting plate 110 and the base plate 120 can be less than 5 cm. In practical applications, the connecting portion 130 can be fiber cloth, unstretchably connecting with the contacting plate 110 and the base plate 120, and sealing up the space S. However, this choice of material of the connecting portion 130 does not intend to limit the present disclosure.

Please go back to FIG. 3. As shown in FIG. 3, the sole cushioning module 100 further includes a protruding block 150. The protruding block 150 is located within the space S and is connected with the contacting plate 110. The protruding block 150 has an arcuate surface 151. A location of the arcuate surface 151 corresponds to the end, i.e., the free end mentioned above, of the first spring leaf 140 opposite to the end of the first spring leaf 140 connecting with the base plate 120. To be more specific, the curvature of the arcuate surface 151 is calculated according to the locus of movement of the free end of the first spring leaf 140 when the first spring leaf 140 deforms and bends, and the contacting plate 110 and the base plate 120 move relatively in the perpendicular direction merely. The arcuate surface 151 is configured to assist the free end to move in a correct locus, helping to prevent the contacting plate 110 and the base plate 120 from moving forwards or backwards relatively in the horizontal direction.

In practical applications, as shown in FIGS. 1-2, the contacting plate 110 further includes a front subsidiary contacting plate 111, a rear subsidiary contacting plate 112 and a pivoting portion 113. The front subsidiary contacting plate 111 abuts against a front portion of the sole 200*a*, which corresponds to the forefoot of the user. The rear subsidiary contacting plate 112 abuts against a rear portion of the sole 200*a*, which corresponds to the heel of the user. The pivoting portion 113 pivotally connects the front subsidiary contacting plate 111 and the rear subsidiary contacting plate 112, such that the front subsidiary contacting plate 111 and the rear subsidiary contacting plate 112 are able to rotate relatively. In this embodiment, the sole cushioning module 100 can abut against the front portion of the sole 200*a* through the front subsidiary contacting plate 111, and abut against the rear portion of the sole 200*a* through the rear subsidiary contacting plate 112. For example, the pivoting portion 113 can be of a hinge structure, a soft material, a non-stiff flexible material, etc. However, this choice of material of the pivoting portion 113 does not intend to limit the present disclosure.

Figure 5:
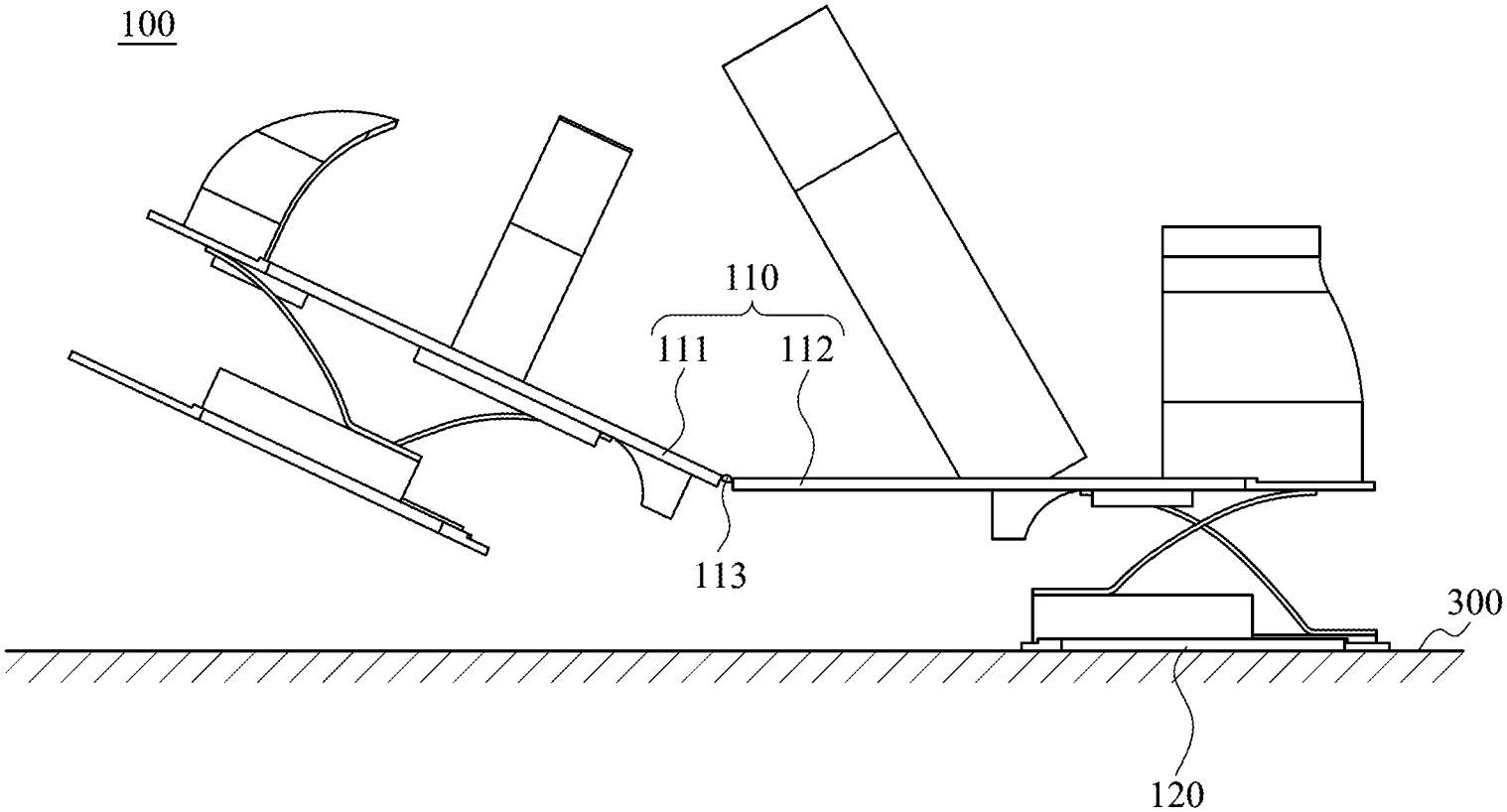
FIGS. 5-6 are schematic views of application of the sole cushioning module of FIG. 1.
Figure 6:
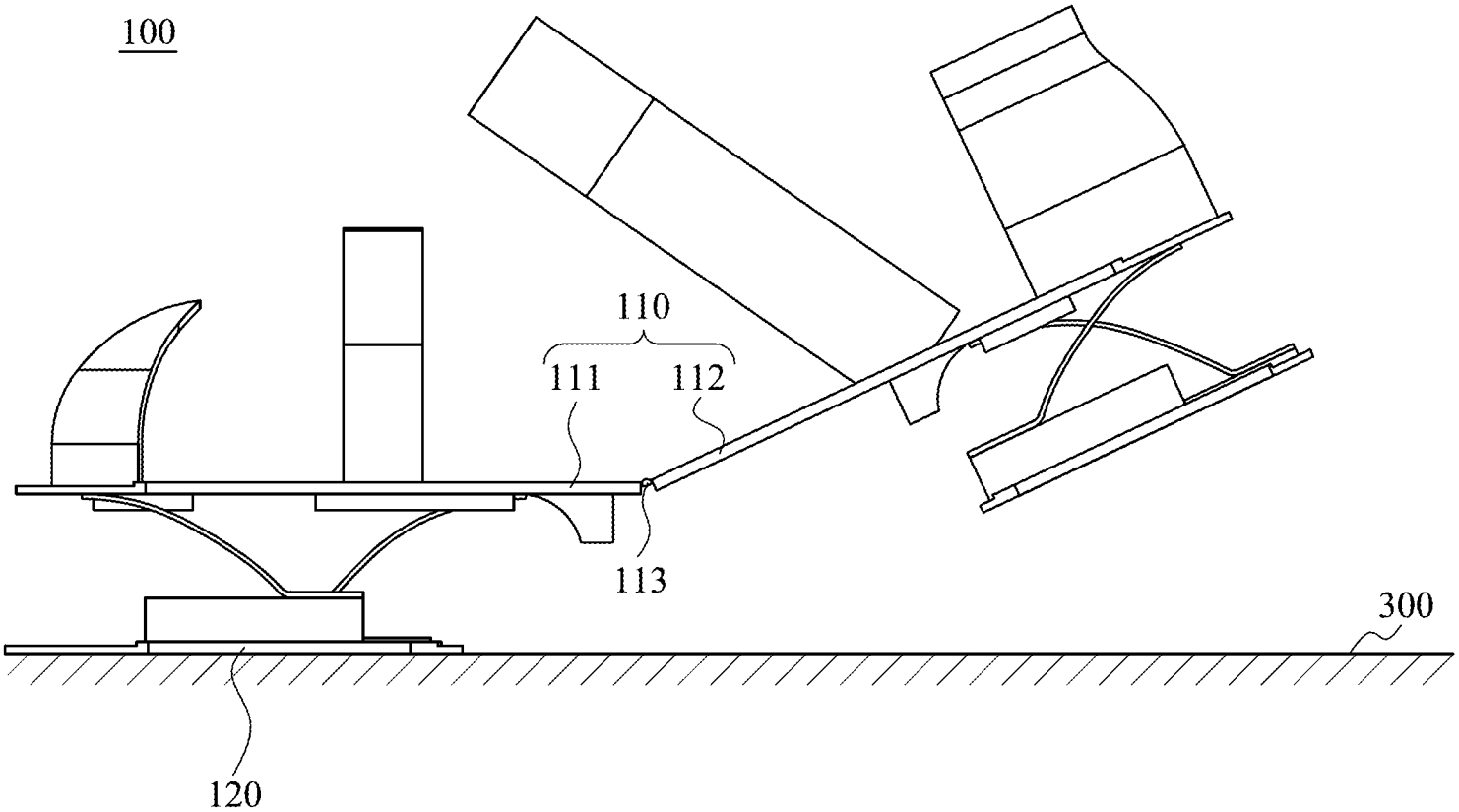

Please refer to FIGS. 5-6. FIGS. 5-6 are schematic views of application of the sole cushioning module 100 of FIG. 1. Generally speaking, when the user walks or runs normally in a natural gait, his heel contacts the ground first, and then his forefoot contacts the ground. Afterwards, his heel leaves from the ground first, and then the whole foot leaves the ground. Therefore, as shown in FIGS. 5-6, through the pivoting portion 113 which allows the front subsidiary contacting plate 111 and the rear subsidiary contacting plate 112 to rotate relatively, the sole cushioning module 100 can effectively match with the normal and natural gait of the user. In addition, since the face of the base plate 120 facing the ground 300 abuts against the ground 300, the gait of the user can become more stable.

Figure 7:
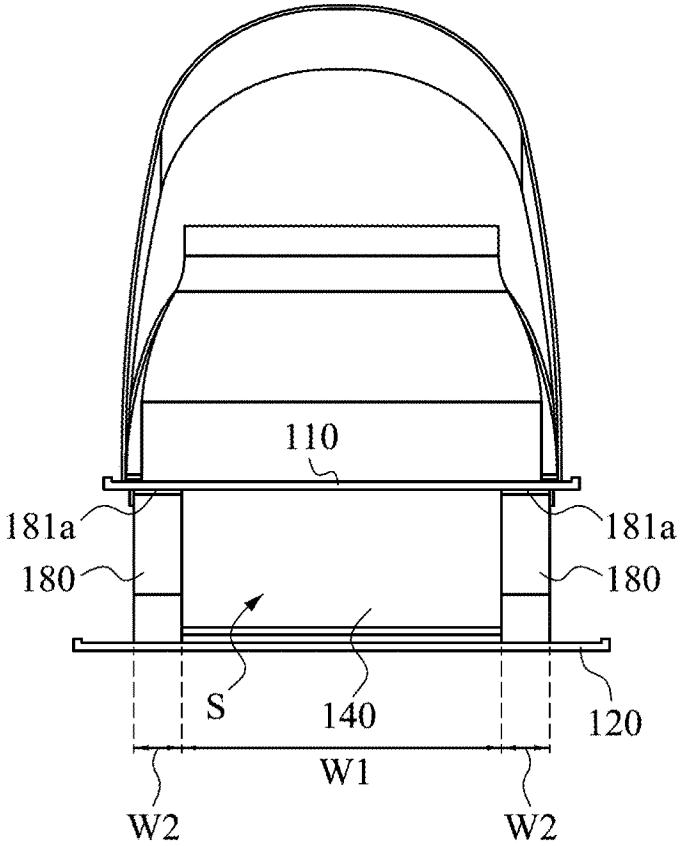
FIG. 7 is a rear view of the sole cushioning module of FIG. 1.

Reference is made to FIG. 7. FIG. 7 is a rear view of the sole cushioning module 100 of FIG. 1. As shown in FIGS. 1-2, 7, the sole cushioning module 100 further includes a second spring leaf 180. Similarly, the second spring leaf 180 is located within the space S. An end of the second spring leaf 180 connects with the base plate 120. The second spring leaf 180 and the base plate 120 form a second included angle a2, and the second spring leaf 180 is in a curved shape, such that the second spring leaf 180 forms a second outer curved surface 181. A second region 181*a* of the second outer curved surface 181 at least partially abuts against the contacting plate 110. Similarly, when the contacting plate 110 moves towards the base plate 120, the contacting plate 110 presses against the second outer curved surface 181, such that the second spring leaf 180 deforms and bends, and the second outer curved surface 181 at least partially slides relative to the contacting plate 110. Consequently, the second region 181*a* of the second outer curved surface 181 abutting against the contacting plate 110 shifts towards the end of the second spring leaf 180 connecting with the base plate 120. In addition, the second included angle a2 and the first included angle a1 face to each other. There exists a distance between the first region 141*a* of the first outer curved surface 141 abutting against the contacting plate 110 and the second region 181*a* of the second outer curved surface 181 abutting against the contacting plate 110, such that the first spring leaf 140 and the second spring leaf 180 can support the contacting plate 110 with dual regions (i.e., the first region 141*a* and the second region 181*a*) throughout the process of walking or running. Thus, the gait can be more stable when the contacting plate 110 moves towards the base plate 120.

In order to further increase the stability by a more even force distribution, as shown in FIG. 7, in this embodiment, a quantity of the second spring leaf 180 is a pair, and the first spring leaf 140 is located between the second spring leaves 180. In practical applications, the width W1 of the first spring leaf 140 can be larger than, equal to or smaller than a sum of the widths W2 of the two second spring leaves 180 (please refer FIG. 7 for the width W1 and the width W2). According to the actual conditions, the width W1 of the first spring leaf 140 can be smaller than the width W2 of the second spring leaf 180. However, this does not intend to limit the present disclosure.

Figure 8:
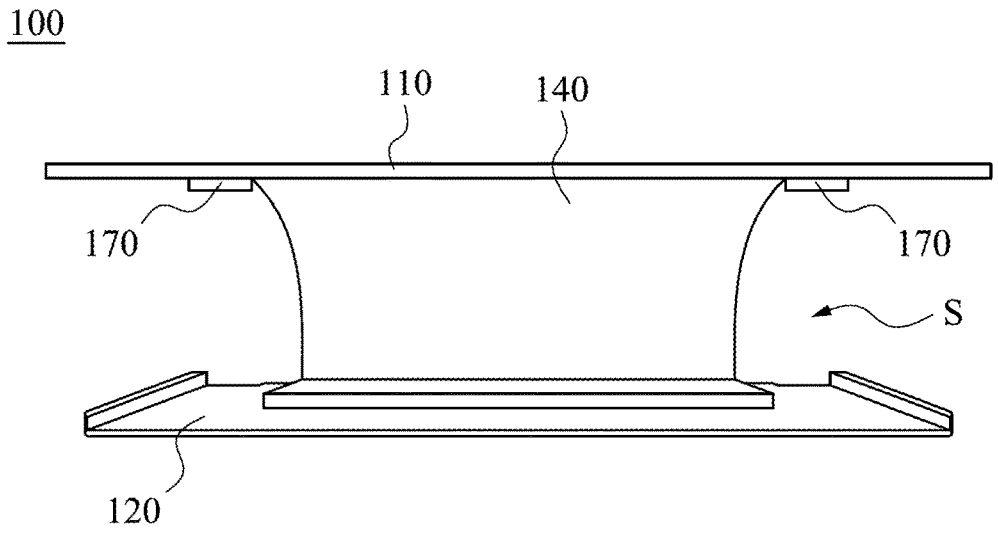
FIG. 8 is a cross-sectional view of the sole cushioning module along the sectional-line X of FIG. 2.

Reference is made to FIG. 8. FIG. 8 is a cross-sectional view of the sole cushioning module 100 along the sectional-line X of FIG. 2. As shown in FIG. 8, the sole cushioning module 100 further includes at least one side stopper 170. The side stopper 170 is located within the space S and is connected with the contacting plate 110. The side stopper 170 abuts against a side of the first spring leaf 140. To be more specific, in this embodiment, a quantity of the side stopper 170 is a pair. The side stoppers 170 relatively abut against two opposite sides of the first spring leaf 140, so as to keep the first spring leaf 140 maintain in the route of sliding relative to the contacting plate 110.

Figure 9:
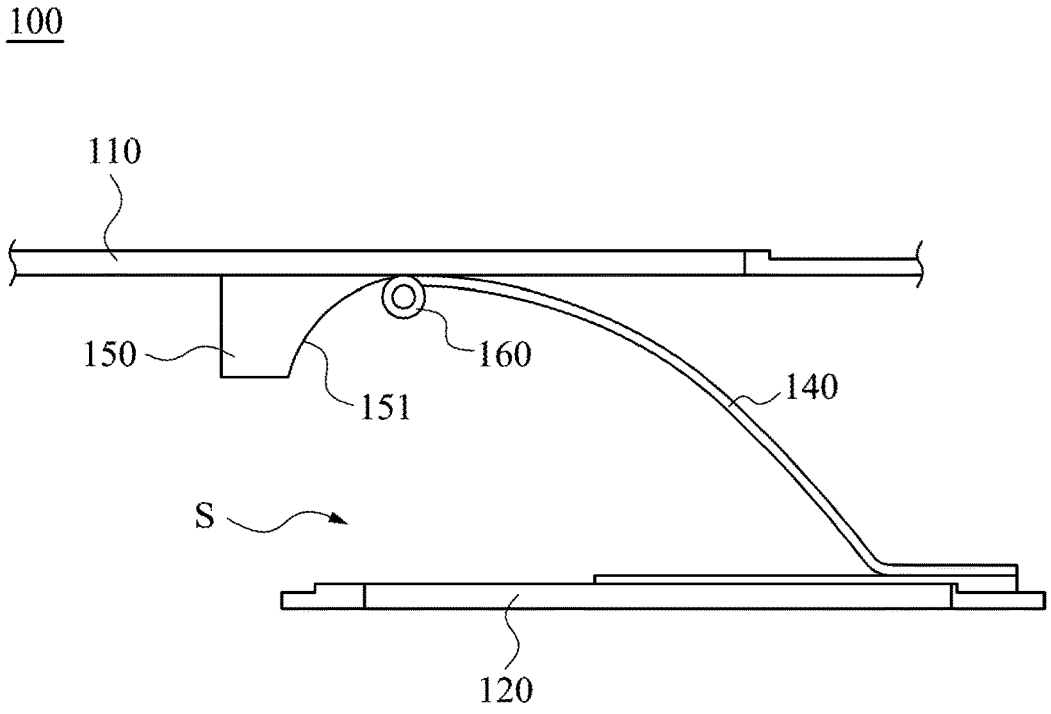
FIG. 9 is a schematic view of a first spring leaf of a sole cushioning module according to another embodiment of the present disclosure.

Reference is made to FIG. 9. FIG. 9 is a schematic view of a first spring leaf 140 of a sole cushioning module 100 according to another embodiment of the present disclosure. As shown in FIG. 9, the sole cushioning module 100 further includes a roller 160. The roller 160 is located at the end, i.e., the free end mentioned above, of the first spring leaf 140 opposite to the end of the first spring leaf 140 connecting with the base plate 120. The roller 160 rolls along the arcuate surface 151 of the protruding block 150, such that the free end can move more freely along the arcuate surface 151. The chance that the free end rubs against the arcuate surface 151 is also avoided.

Figure 10:
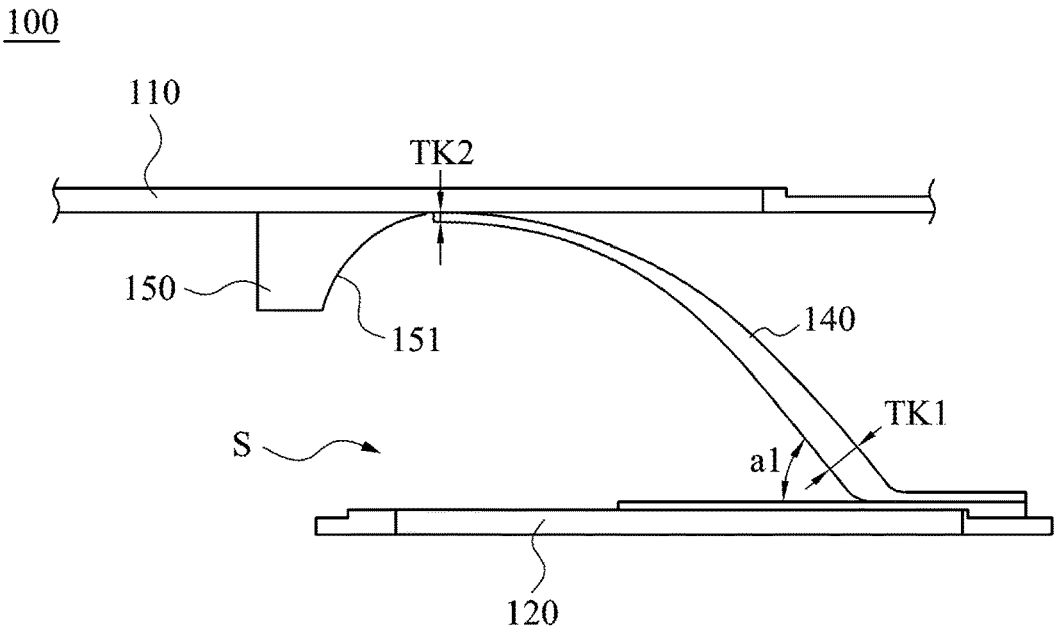
FIG. 10 is a schematic view of a first spring leaf of a sole cushioning module according to a further embodiment of the present disclosure.

Please refer to FIG. 10. FIG. 10 is a schematic view of a first spring leaf 140 of a sole cushioning module 100 according to a further embodiment of the present disclosure. As shown in FIG. 10, the end of the first spring leaf 140 connecting with the base plate 120 has a first thickness TK1. Another end, i.e., the free end mentioned above, of the first spring leaf 140 has a second thickness TK2. In this embodiment, the first thickness TK1 is thicker than the second thickness TK2, such that the moment of inertia of the end of the first spring leaf 140 connecting with the base plate 120 becomes relatively larger. This also means that equivalent stiffness k of the first spring leaf 140 at the end connecting with the base plate 120 resisting against the pressure from the contacting plate 110 to the first spring leaf 140 is also correspondingly increased.

Figure 11:
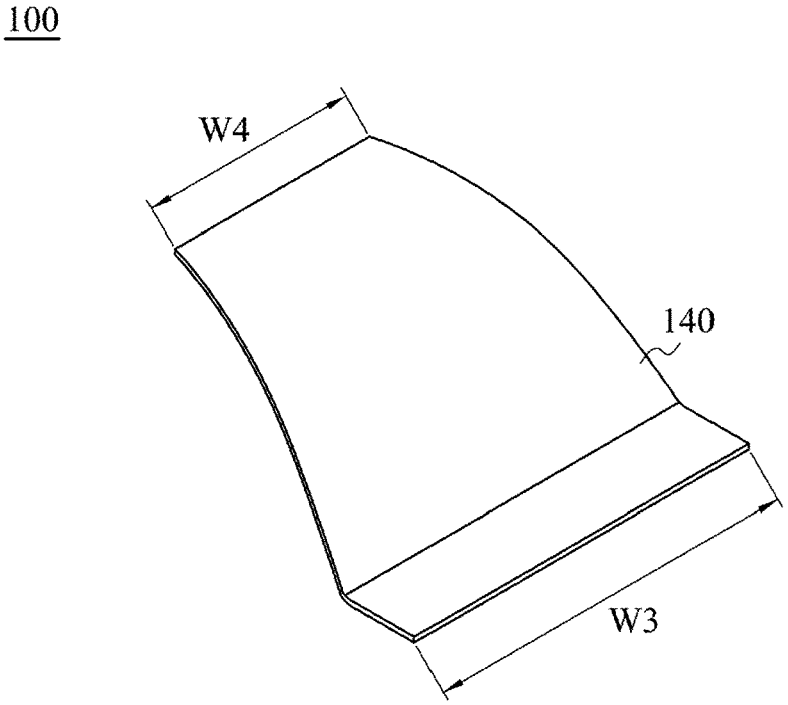
FIG. 11 is a schematic view of a first spring leaf of a sole cushioning module according to another embodiment of the present disclosure.

Reference is made to FIG. 11. FIG. 11 is a schematic view of a first spring leaf 140 of a sole cushioning module 100 according to another embodiment of the present disclosure. As shown in FIG. 11, the end of the first spring leaf 140 connecting with the base plate 120 (not shown in FIG. 11) has a first width W3. Another end, i.e., the free end mentioned above, of the first spring leaf 140 has a second width W4. In this embodiment, the first width W3 is wider than the second width W4, such that the moment of inertia of the end of the first spring leaf 140 connecting with the base plate 120 becomes relatively larger. This also means that equivalent stiffness k of the first spring leaf 140 at the end connecting with the base plate 120 resisting against the pressure from the contacting plate 110 to the first spring leaf 140 is also correspondingly increased.

Figure 12:
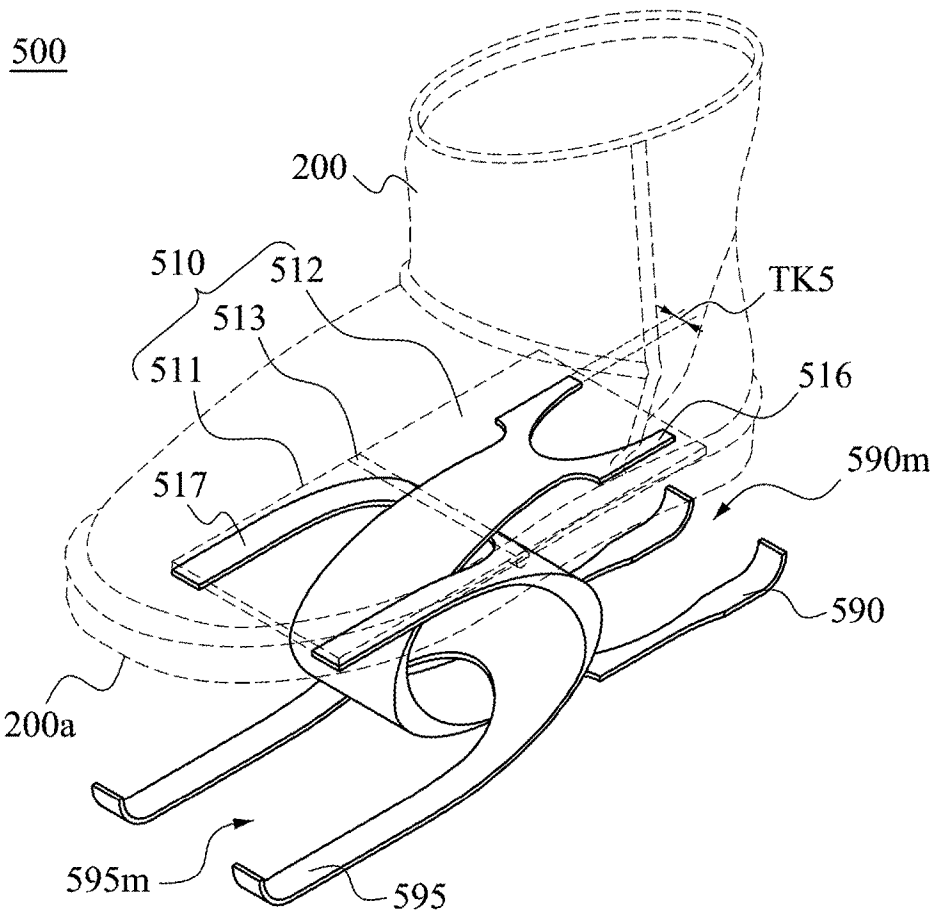
FIG. 12 is a schematic view of a sole cushioning module according to another embodiment of the present disclosure.
Figure 13:
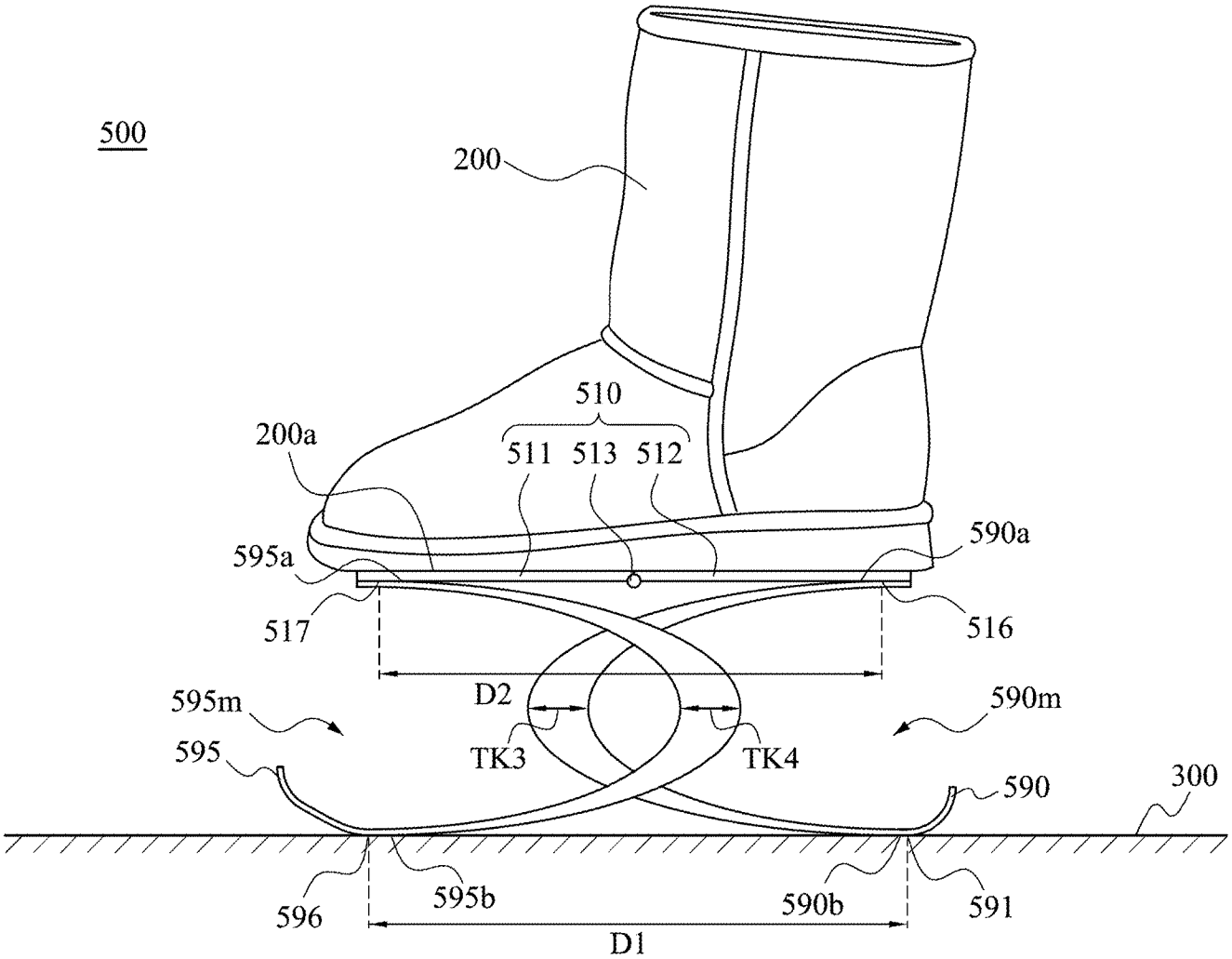
FIG. 13 is a side view of the sole cushioning module of FIG. 12, in which the first spring leaf and the second spring leaf are not yet pressed.
Figure 14:
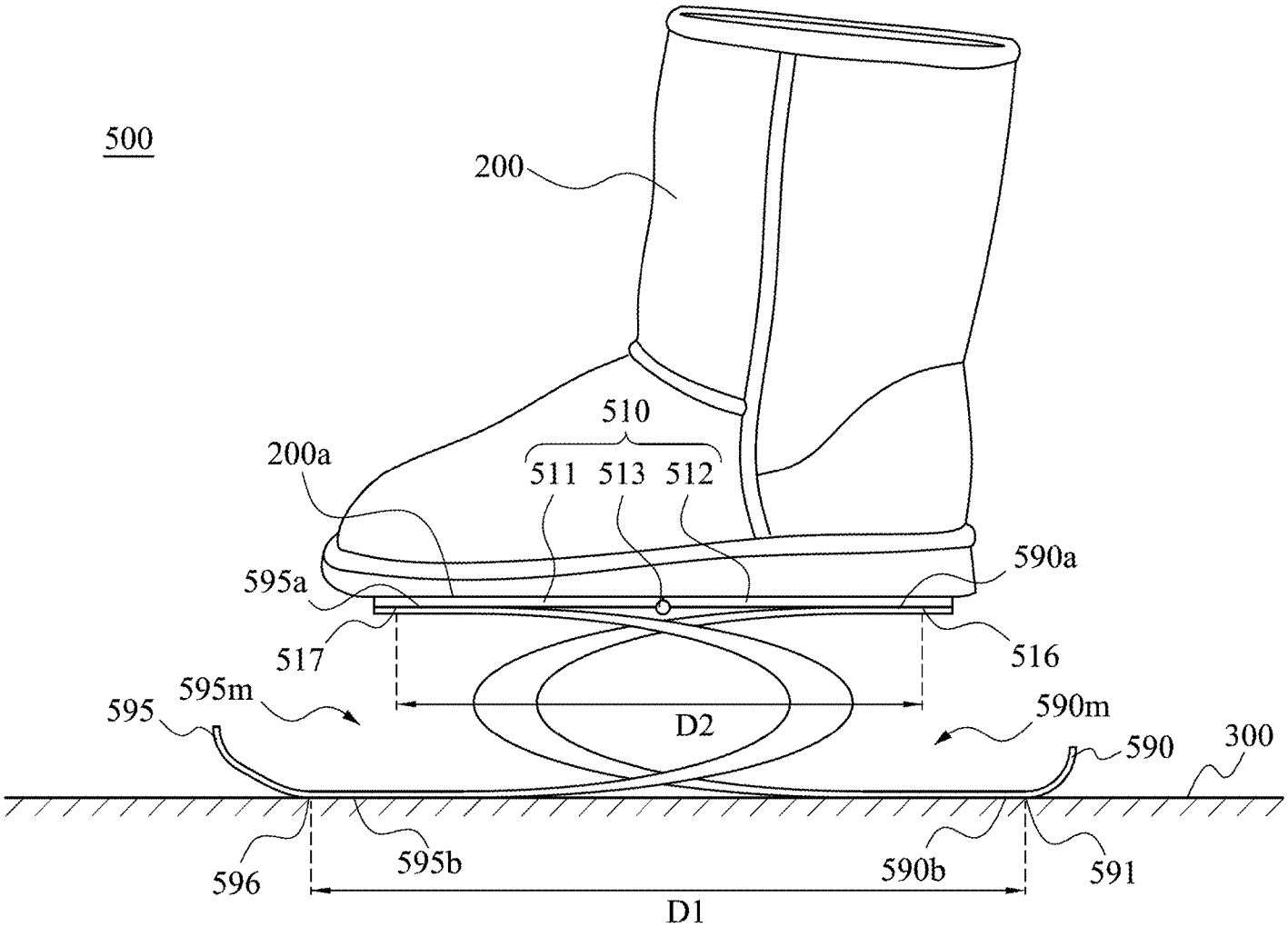
FIG. 14 is a side view of the sole cushioning module of FIG. 12, in which the contacting plate presses against the first spring leaf and the second spring leaf.

Reference is made to FIGS. 12-14. FIG. 12 is a schematic view of a sole cushioning module 500 according to another embodiment of the present disclosure. FIG. 13 is a side view of the sole cushioning module 500 of FIG. 12, in which the first spring leaf 590 and the second spring leaf 595 are not yet pressed. FIG. 14 is a side view of the sole cushioning module 500 of FIG. 12, in which the contacting plate 510 presses against the first spring leaf 590 and the second spring leaf 595. As shown in FIGS. 12-14, a sole cushioning module 500 includes a contacting plate 510, a first spring leaf 590 and a second spring leaf 595. The contacting plate 510 abuts against the sole 200*a* of the shoe 200. The contacting plate 510 has a first connecting point 516 and a second connecting point 517 opposite to each other. The first connecting point 516 and the second connecting point 517 are opposite to the sole 200*a*. The first spring leaf 590 and the second spring leaf 595 respectively are in a "C" shape and are configured to abut against the ground 300. The first spring leaf 590 and the second spring leaf 595 respectively form a first opening 590*m* and a second opening 595*m*. An end of the first spring leaf 590 connects with the first connecting point 516. Another end of the first spring 590 leaf is a free end. A part of the first spring leaf 590 near a center of the "C" shape has a third thickness TK3 thicker than the ends of the first spring leaf 590. An end of the second spring leaf 595 connects with the second connecting point 517. Another end of the second spring leaf 595 is a free end. A part of the second spring leaf 595 near a center of the "C" shape has a fourth thickness TK4 thicker than the ends of the second spring leaf 595. The first spring leaf 590 and the second spring leaf 595 are disposed opposite to each other, such that the first opening 590*m* and the second opening 595*m* face to opposite directions. In practical applications, the contacting plate 510 and the sole 200*a* can be an integrally formed structure.

When the user wears the shoe 200, and the contacting plate 510 of the sole cushioning module 500 abuts against the sole 200*a* of the shoe 200, the force that the user steps on the ground 300 will be transmitted to the first spring leaf 590 through the contacting plate 510, such that the first spring leaf 590 deforms and bends, and consequently stores an elastic potential energy. At the same time, the force that the user steps on the ground 300 will come together with a reaction force from the ground 300 against the first spring leaf 590. The reaction force is of the same magnitude but opposite direction to the force that the user steps on the ground 300. Because of the reaction force acting against the first spring leaf 590, it can also be understood that the reaction force is transmitted to the first spring leaf 590. In addition, this makes the step of the user achieve an effect of cushioning, facilitating to reduce the chance of injury of the leg, especially the joint of lower limb, caused by too large the reaction force when the user steps.

With the natural gait of the user, the center of gravity moves forwards, such that the stepping force of the user slowly shifts from the first spring leaf 590 to the second spring leaf 595. The force that the user steps on the ground 300 will be transmitted to the second spring leaf 595 through the contacting plate 510, such that the second spring leaf 595 deforms and bends, and consequently stores an elastic potential energy. Similarly, at the same time, the force that the user steps on the ground 300 will come together with a reaction force from the ground 300 against the second spring leaf 595. Again, the reaction force is of the same magnitude but opposite direction to the force that the user steps on the ground 300. Because of the reaction force acting against the second spring leaf 595, it can also be understood that the reaction force is transmitted to the second spring leaf 595. Meanwhile, the first spring leaf 590 releases the elastic potential energy stored, such that the step of the user becomes light, and the user can walk with less effort. In order to make the shifting of the stepping force from the first spring leaf 590 to the second spring leaf 595 more smoothly, in this embodiment, as shown in FIGS. 12-14, the first spring leaf 590 and the second spring leaf 595 can be at least partially located within the space of each other.

To be more specific, when the contacting plate 510 moves towards the ground 300 and presses against the first spring leaf 590, the first spring leaf 590 at least partially abuts against the contacting plate 510 and forms a first region 590*a*. An extent of the first region 590*a* correspondingly increases with the movement of the contacting plate 510 towards the ground 300, such that the bending moment which the contacting plate 510 exerts on the first spring leaf 590 is correspondingly reduced. Thus, the degree of deformation of the first spring leaf 590 is correspondingly reduced. On the other hand, the first spring leaf 590 at least partially abuts against the ground 300 and forms a second region 590*b*. An extent of the second region 590*b* correspondingly increases with the movement of the contacting plate 510 towards the ground 300, such that the bending moment exerting on the first spring leaf 590 is correspondingly reduced due to the reduction of the moment arm of the reaction force from the ground 300. Thus, the degree of deformation of the first spring leaf 590 is also reduced. Therefore, this also means that when the first spring leaf 590 resists to the pressing of the contacting plate 510 against the first spring leaf 590, the effect of corresponding increase of the stiffness of the first spring leaf 590 is achieved.

Figure 15:
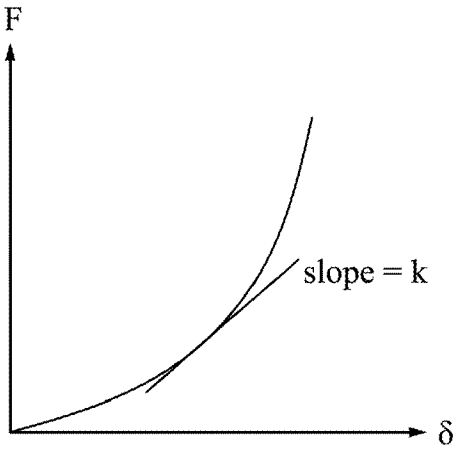
FIG. 15 is a graph showing an equivalent stiffness of the first spring leaf of FIG. 12.

Reference is made to FIG. 15. FIG. 15 is a graph showing an equivalent stiffness k of the first spring leaf 590 of FIG. 12. As shown in FIG. 15, similarly, the slope of the curve of FIG. 15 is equal to the equivalent stiffness k of the first spring leaf 590, in which the equivalent stiffness k is the stiffness of the first spring leaf 590 against the vertical force F from the contacting plate 510. Under the condition of reducing bending moment and increasing stiffness, with the pressing of contacting plate 510 against the first spring leaf 590, the difficulty for the first spring leaf 590 to keep deforming and bending will be increased, such that the equivalent stiffness k of the first spring leaf 590 will change with an amplitude of non-linear increment with regard to the increase of the compression distance δ (corresponds to the degree of the deformation and bending of the first spring leaf 590) between the contacting plate 510 and the ground 300. In this way, when the user steps on the ground 300, the sole cushioning module 500 will effectively absorb the force the user steps on the ground 300 through the deformation and bending of the first spring leaf 590. Thus, the user is cushioned when stepping, and the chance of injury of the leg, especially the joint of lower limb, caused by too large the reaction force when the user steps is reduced. In addition, as mentioned above, the equivalent stiffness k of the first spring leaf 590 will gradually change with an amplitude of non-linear increment, until the first spring leaf 590 deforms and bends to an extent capable to support the stepping force of the user on the ground 300, or until the stepping force of the user on the ground 300 is transferred to the second spring leaf 595. Therefore, the process from cushioning to supporting by the first spring leaf 590 to the stepping force of the user can be carried out smoothly. When the user use his foot to pedal downwards, the first spring leaf 590 will spring back to release the elastic potential energy stored, and provide an elastic force to the contacting plate 510. This facilitates to lift up the contacting plate 510 and the sole 200*a*, such that the user can save more effort when moving forwards or jumping upwards through the additional elastic force from the sole cushioning module 100.

Furthermore, as mentioned above, the part of the first spring leaf 590 near the center of the "C" shape has the third thickness TK3 thicker than the ends of the first spring leaf 590, while the part of the second spring leaf 595 near the center of the "C" shape has the fourth thickness TK4 thicker than the ends of the second spring leaf 595. As a result, the equivalent stiffness of first spring leaf 590 and the second spring leaf 595 respectively resisting against the deformation and bending are increased. Thus, the first spring leaf 590 and the second spring leaf 595 are more readily to support the stepping force of the user.

Please go back to FIGS. 12-14. On the other hand, when the contacting plate 510 moves towards the ground 300 and presses against the second spring leaf 595, the second spring leaf 595 at least partially abuts against the contacting plate 510 and forms a third region 595*a*. An extent of the third region 595*a* correspondingly increases with the movement of the contacting plate 510 towards the ground 300, such that the bending moment which the contacting plate 510 exerts on the second spring leaf 595 is correspondingly reduced. Thus, the degree of deformation of the second spring leaf 595 is also reduced. Meanwhile, the second spring leaf 595 at least partially abuts against the ground 300 and forms a fourth region 595*b*. An extent of the fourth region 595*b* correspondingly increases with the movement of the contacting plate 510 towards the ground 300, such that the bending moment exerting on the second spring leaf 595 due to the reaction force from the ground 300 is correspondingly reduced. Thus, the degree of deformation of the second spring leaf 595 is also reduced. Therefore, this also means that when the second spring leaf 595 resists to the pressing of the contacting plate 510 against the second spring leaf 595, the effect of corresponding increase of the equivalent stiffness of the second spring leaf 595 is achieved.

In addition, as shown in FIGS. 13-14, the first spring leaf 590 has a first abutting point 591. The first abutting point 591 is located at an end of the second region 590*b* near to the first opening 590*m*. The second spring leaf 595 has a second abutting point 596. The second abutting point 596 is located at an end of the fourth region 595*b* near to the second opening 595*m*. When the user stands up while using the sole cushioning module 500, a first distance D1 between the first abutting point 591 and the second abutting point 596 is longer than a second distance D2 between the first connecting point 516 and the second connecting point 517. In this way, when standing up, walking or running with the usage of the sole cushioning module 500, the stability is increased.

In practical applications, as shown in FIGS. 12-14, the contacting plate 510 further includes a front subsidiary contacting plate 511, a rear subsidiary contacting plate 512 and a pivoting portion 513. The front subsidiary contacting plate 511 abuts against a front portion of the sole 200*a*, which corresponds to the forefoot of the user. The rear subsidiary contacting plate 512 abuts against a rear portion of the sole 200*a*, which corresponds to the heel of the user. The pivoting portion 513 pivotally connects the front subsidiary contacting plate 511 and the rear subsidiary contacting plate 512, such that the front subsidiary contacting plate 511 and the rear subsidiary contacting plate 512 are able to rotate relatively. In this embodiment, the sole cushioning module 500 can abut against the front portion of the sole 200*a* through the front subsidiary contacting plate 511, and abut against the rear portion of the sole 200*a* through the rear subsidiary contacting plate 512. For example, the pivoting portion 513 can be of a hinge structure, a soft material, a non-stiff flexible material, etc. However, this choice of material of the pivoting portion 513 does not intend to limit the present disclosure.

Furthermore, as shown in FIG. 12, the first spring leaf 590 has a fifth width TK5 near the end of the first spring leaf 590 connecting with the first connecting point 516. The fifth width TK5 is substantially perpendicular with the direction of the extension of the first spring leaf 590. In this embodiment, the fifth width TK5 becomes gradually wider as it gets nearer to the center of the "C" shape. As a result, the equivalent stiffness of first spring leaf 590 resisting against the deformation and bending further is increased. Thus, the first spring leaf 590 is more readily to support the stepping force of the user.

Figure 16:
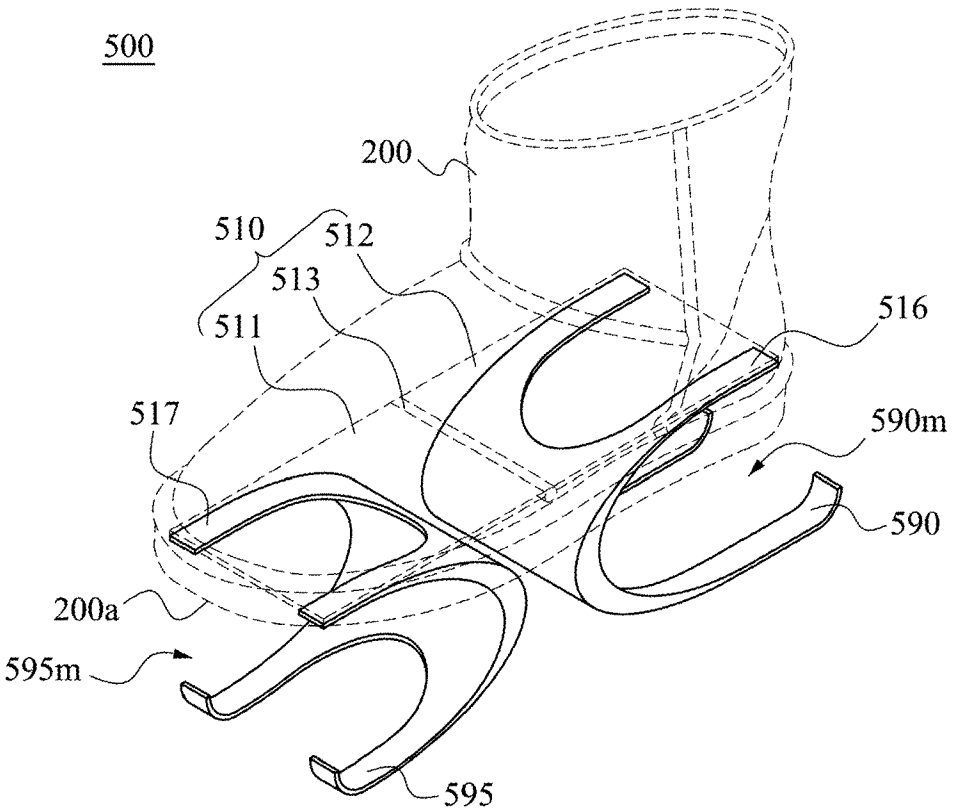
FIG. 16 is a schematic view of a sole cushioning module according to a further embodiment of the present disclosure.

Reference is made to FIG. 16. FIG. 16 is a schematic view of a sole cushioning module 500 according to a further embodiment of the present disclosure. The difference between this embodiment shown in FIG. 16 and the previous embodiment is that the first spring leaf 590 and the second spring leaf 595 are not located within the space of each other according to the actual conditions.

In conclusion, when compared with the prior art, the aforementioned embodiments of the present disclosure have at least the following advantages.

(1) With the pressing of contacting plate against the first spring leaf, the difficulty for the first spring leaf to keep deforming and bending will be increased, such that the equivalent stiffness of the first spring leaf will change with an amplitude of non-linear increment with regard to the increase of the compression distance between the contacting plate and the base plate. In this way, when the user steps on the ground, the sole cushioning module will effectively absorb the force the user steps on the ground through the deformation and bending of the first spring leaf. Thus, the user is cushioned when stepping, and the chance of injury of the leg, especially the joint of lower limb, caused by too large the reaction force when the user steps is reduced. In addition, as mentioned above, the equivalent stiffness of the first spring leaf will gradually change with an amplitude of non-linear increment, until the first spring leaf deforms and bends to an extent capable to support the force that the user steps on the ground. Therefore, the process from cushioning to supporting by the first spring leaf to the stepping force of the user can be carried out smoothly. When the user use his foot to pedal downwards, the first spring leaf will spring back to release the elastic potential energy stored, and provide an elastic force to the contacting plate. This facilitates to lift up the contacting plate and the sole, such that the user can save more effort when moving forwards or jumping upwards through the additional elastic force from the sole cushioning module.

(2) Through the pre-compression of the first spring leaf, the initial distance between the contacting plate and the base plate becomes closer, such that the overall height of the sole cushioning module can be reduced, facilitating the stability of the sole cushioning module when used by the user.

(3) Through the pivoting portion which allows the front subsidiary contacting plate and the rear subsidiary contacting plate to rotate relatively, the sole cushioning module can effectively match with the normal and natural gait of the user.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A sole cushioning module, comprising:

a contacting plate configured to abut against a sole;

a base plate configured to abut against a ground, the base plate and the contacting plate forming a space in between;

a connecting portion unstretchably connecting with the contacting plate and the base plate;

a first spring leaf located within the space, the first spring leaf having a first end and an opposite second end, the first end of the first spring leaf connecting with the base plate, the first spring leaf and the base plate forming a first included angle, and the first spring leaf being in a curved shape, such that the first spring leaf forms a first outer curved surface, a first region of the first outer curved surface at least partially and slidably abutting against the contacting plate; and a protruding block located within the space and connected with the contacting plate, the protruding block having an arcuate surface, the arcuate surface is curved along a locus of movement of the second end of the first spring leaf when the first spring leaf deforms and bends;

wherein when the contacting plate moves towards the base plate, the contacting plate presses on the first outer curved surface, such that the first spring leaf deforms and bends, and the first outer curved surface at least partially slides relative to the contacting plate, and consequently the first region of the first outer curved surface abutting against the contacting plate shifts towards the first end of the first spring leaf connecting with the base plate.

2. The sole cushioning module of claim 1, wherein the second end of the first spring leaf is a free end.

3. The sole cushioning module of claim 1, wherein a location of the arcuate surface corresponds to the second end of the first spring leaf.

4. The sole cushioning module of claim 1, further comprising:

a roller located at the second end of the first spring leaf, the configured to roll along the arcuate surface.

5. The sole cushioning module of claim 1, wherein the first end of the first spring leaf has a first width, the second end of the first spring leaf has a second width, the first width is greater than the second width.

6. The sole cushioning module of claim 1, wherein the first end of the first spring leaf has a first thickness, the second end of the first spring leaf has a second thickness, the first thickness is greater than the second thickness.

7. The sole cushioning module of claim 1, further comprising:

at least one side stopper located within the space and connected with the contacting plate, the side stopper abutting against a side of the first spring leaf.

8. The sole cushioning module of claim 1, further comprising:

a second spring leaf located within the space, an end of the second spring leaf connecting with the base plate, the second spring leaf and the base plate forming a second included angle, and the second spring leaf being in a curved shape, such that the second spring leaf forms a second outer curved surface, a second region of the second outer curved surface at least partially abutting against the contacting plate, the second included angle and the first included angle facing to each other.

9. The sole cushioning module of claim 8, wherein a quantity of the second spring leaf is two, the first spring leaf is located between the second spring leaves.

10. The sole cushioning module of claim 1, wherein the contacting plate comprises:

a front subsidiary contacting plate configured to abut against a front portion of the sole;

a rear subsidiary contacting plate configured to abut against a rear portion of the sole; and a pivoting portion pivotally connecting the front subsidiary contacting plate and the rear subsidiary contacting plate, such that the front subsidiary contacting plate and the rear subsidiary contacting plate are able to rotate relatively.

* * * * *